US009484636B2

(12) United States Patent
Mobrem

(10) Patent No.: US 9,484,636 B2
(45) Date of Patent: Nov. 1, 2016

(54) MESH REFLECTOR WITH TRUSS STRUCTURE

(71) Applicant: Mehran Mobrem, Santa Barbara, CA (US)

(72) Inventor: Mehran Mobrem, Santa Barbara, CA (US)

(73) Assignee: Northrop Grumman Systesms Corportion, Falls Church, VA (US)

( * ) Notice: Subject to any disclaimer, the term of this patent is extended or adjusted under 35 U.S.C. 154(b) by 597 days.

(21) Appl. No.: 14/191,052

(22) Filed: Feb. 26, 2014

(65) Prior Publication Data

US 2015/0244081 A1 Aug. 27, 2015

(51) Int. Cl.

| | |
|---|---|
| ***H01Q 15/20*** | (2006.01) |
| ***H01Q 15/16*** | (2006.01) |
| ***H01Q 1/28*** | (2006.01) |

(52) U.S. Cl.

CPC ..... *H01Q 15/168* (2013.01); *H01Q 1/288* (2013.01); *H01Q 15/161* (2013.01)

(58) Field of Classification Search

CPC ..... H01Q 15/161; H01Q 15/168
USPC ..... 343/915, 916, 912
See application file for complete search history.

(56) References Cited

U.S. PATENT DOCUMENTS

| | | | | |
|---|---|---|---|---|
| 5,680,145 | A | 10/1997 | Thomson et al. | |
| 5,864,324 | A * | 1/1999 | Acker | H01Q 15/168 343/912 |
| 5,990,851 | A * | 11/1999 | Henderson | H01Q 1/081 343/840 |
| 6,028,570 | A * | 2/2000 | Gilger | H01Q 1/288 343/880 |
| 6,195,067 | B1 * | 2/2001 | Gilger | H01Q 1/288 343/912 |
| 6,225,965 | B1 * | 5/2001 | Gilger | H01Q 1/288 343/912 |
| 6,278,416 | B1 | 8/2001 | Harless | |
| 7,595,769 | B2 * | 9/2009 | Bassily | H01Q 15/161 343/915 |

FOREIGN PATENT DOCUMENTS

| | | |
|---|---|---|
| EP | 2 040 330 A1 | 3/2009 |
| WO | WO 2007/100868 A2 | 9/2007 |

* cited by examiner

*Primary Examiner* — Khai M Nguyen
(74) *Attorney, Agent, or Firm* — Tarolli, Sundheim, Covell & Tummino LLP

(57) ABSTRACT

A reflector assembly includes a frame centered about a longitudinal axis, a first curved body extending from the frame, and a second curved body extending from the frame and connected to the first curved body for supporting the first curved body. A reflective mesh has an electromagnetically reflective surface and a support structure secures the reflective mesh to the first curved body and spaces the reflective mesh away from the first body towards the second body.

20 Claims, 11 Drawing Sheets

MESH REFLECTOR WITH TRUSS STRUCTURE

TECHNICAL FIELD

The present invention relates generally to reflector assemblies, and specifically to electromagnetic reflectors antennas for use in space and on spacecraft.

BACKGROUND

Reflectors for concentrating radiofrequency (RF) radiation are employed in a variety of antennas installed in spacecraft or mounted on the ground. Reflectors for concentrating solar radiation are employed as solar energy collectors in systems for converting solar energy into electrical energy.

Satellite and communications technologies often require that space-based devices and other high technology machinery be lightweight yet durable to withstand the effects of the space environment. Such devices, however, must also be practically devised to be launched from earth in a small package and deployed in space autonomously.

SUMMARY

One embodiment includes a reflector assembly that includes a frame centered about a longitudinal axis, a first curved body extending from the frame, and a second curved body extending from the frame and connected to the first curved body for supporting the first curved body. A reflective mesh has an electromagnetically reflective surface and a support structure secures the reflective mesh to the first curved body and spaces the reflective mesh away from the first body towards the second body.

Another embodiment of the invention includes a reflector assembly that includes a frame centered about a longitudinal axis and curved first and second bodies extending from the frame. The first curved body includes a plurality of facets each having a plurality of sides. A plurality of tensioning members extends between the first and second bodies for shaping the first body. A reflective mesh is provided and has an electromagnetically reflective surface. A support structure being secured to the sides of the facets of the first body and to the reflective mesh for spacing the reflective mesh away from the first body towards the second body. The support structure includes a plurality of primary support members secured to at least one facet and a plurality of secondary support members secured to the at least one facet. The primary and secondary support members on each facet have different lengths from one another such that the reflective mesh has a different shape than the first body.

Another embodiment of the invention includes a reflector assembly having a frame centered about a longitudinal axis that includes a plurality of longerons pivotable relative to one another and a plurality of struts pivotable relative to one another such that the frame is moveable between a deployed condition and a collapsed condition. A first curved body extends from the frame and includes a plurality of inextensible support members that define a mesh surface having a plurality of facets. A second curved body is connected to the first body by a plurality of tensioning members for maintaining the shape of the curved first body. A flexible, reflective mesh having an electromagnetically reflective surface is provided. A support structure is secured to the first body and to the reflective mesh for spacing the reflective mesh away from the first body towards the second body. The support structure includes a plurality of primary support members secured to at least one facet and a plurality of secondary support members secured to the at least one facet. The primary and secondary support members on each facet have different lengths from one another such that the reflective mesh has a different shape than the first body.

DETAILED DESCRIPTION

The present invention relates generally to reflector assemblies, and specifically to electromagnetic reflector antennas for use in space and on spacecraft. The reflector assembly includes a large-aperture, lightweight reflector antenna that can be compactly stowed during transportation and delivery and thereby prepared for eventual deployment in space. The reflector assembly includes a frame, first and second curved net bodies connected to the frame, and a series of tensioning members extending between and connected to the bodies. A reflective mesh is secured to the first body for receiving and reflecting electromagnetic signals. A support structure secures the reflective mesh to the first body and spaces the reflective mesh away from the first body towards the second body. In one example, the reflective mesh has a different shape than the first body due to the support structure.

Since the tensioning members and support structure maintain the reflective mesh in a taught, curved shape the reflector assembly is ideal for use in antennas due to its ability to precisely receive and reflect RF signals. The frame may be collapsible to form a deployable reflector assembly with articulatable struts or the frame may be fixed to provide an extremely lightweight reflector assembly.

The first body is curved or parabolic and operates as a reflector element for an antenna. The second body is also curved or parabolic and provides structural support for the first net body, but does not shape a radiation pattern of the antenna. The support structure constitutes a plurality of spacers that create smaller, quasi-faceting between the first body and the reflective mesh in order to precisely shape the reflective mesh into a desired curved shape.

Figure 1:
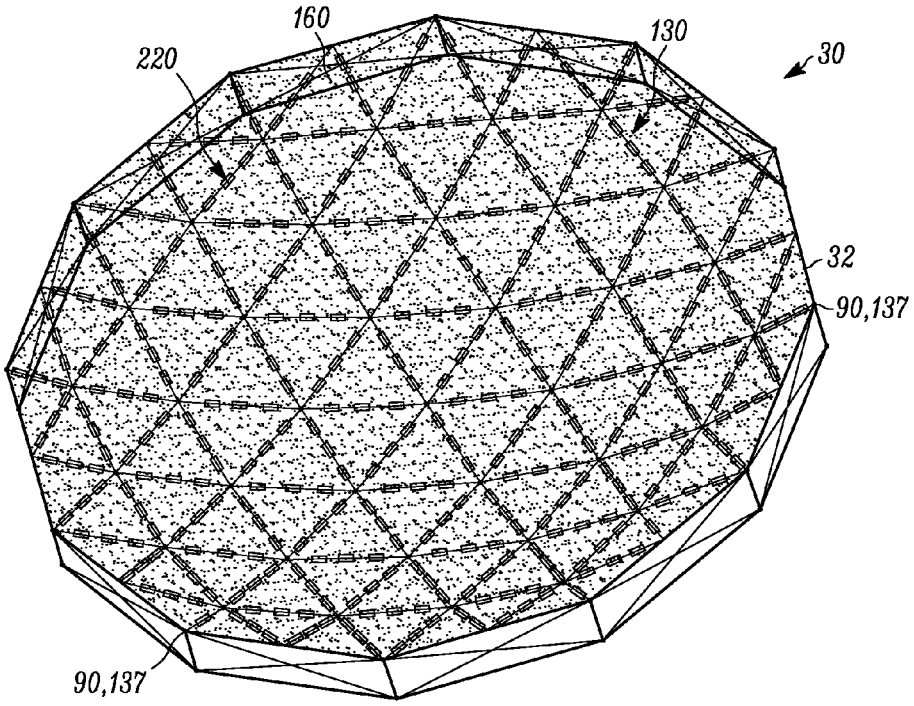
FIG. 1 is a schematic illustration of an example of a reflector assembly.
Figure 2:
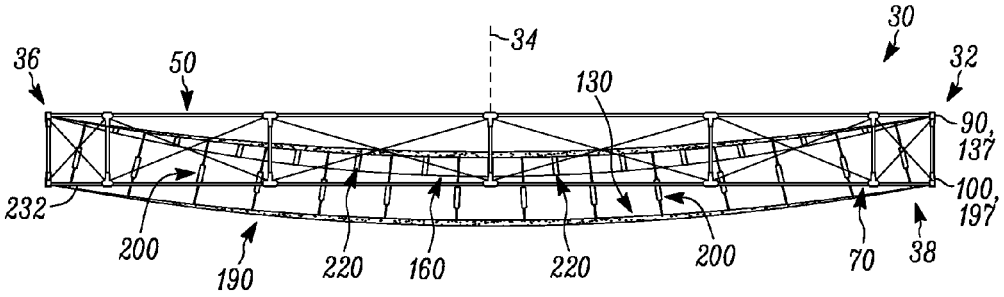
FIG. 2 is a side view of the reflector assembly of FIG. 1.
Figure 3:
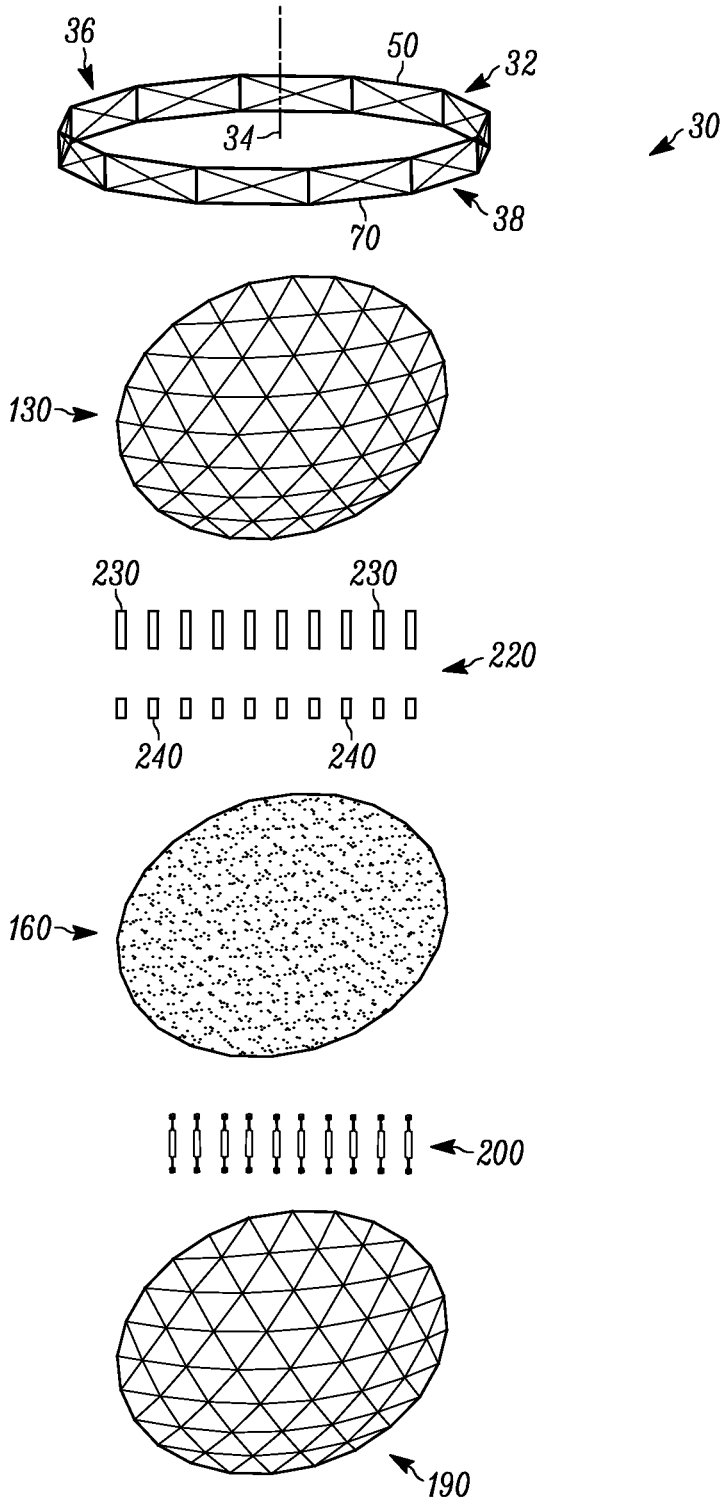
FIG. 3 is an exploded assembly view of the reflector assembly of FIG. 1.

FIGS. 1-3 illustrate an example of a reflector antenna assembly 30 suitable for use in space and on spacecraft. The reflector assembly 30 includes a truss or frame 32, a curved first body 130 that supports an electromagnetically reflective mesh 160, a curved second body 190 that supports and maintains the curved shape of the first body, tensioning members 200 connecting the first and second bodies together to form a rigid structure, and a support structure 220 positioned between the first body 130 and the reflective mesh 160 for helping to precisely shape the reflective mesh.

Figure 4:
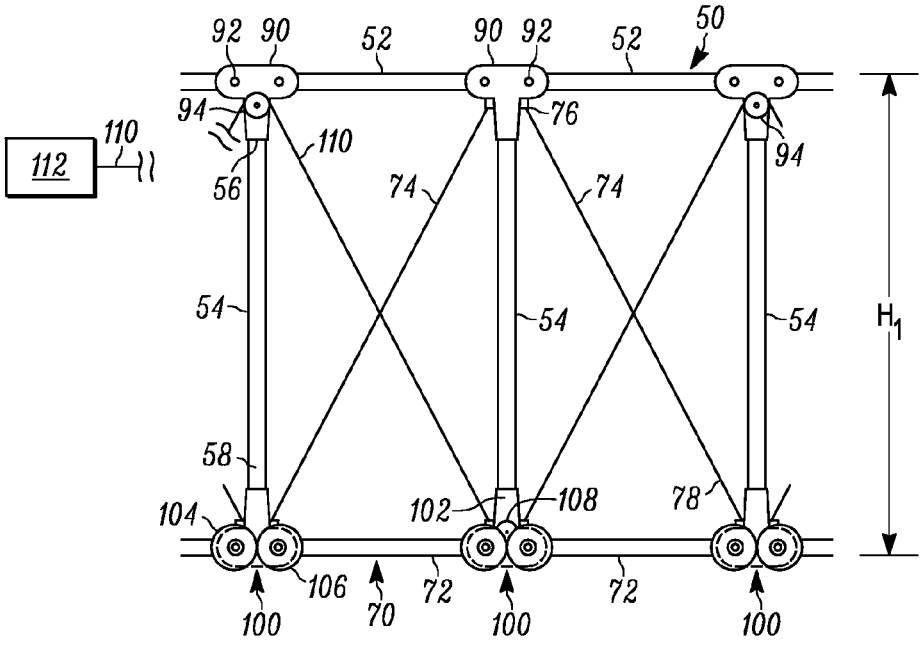
FIG. 4 is a partial view of the frame of FIG. 3 in a deployed condition.

Referring to FIGS. 3-4, the frame 32 has an annular shape and is centered about a longitudinal axis 34. The frame 32 extends along the axis 34 from a front side 36 to a rear side 38, although these spatial designations are interchangeable depending on the spatial orientation of the reflector assembly 30 during use. The frame 32 has a rigid, yet lightweight construction capable of withstanding expected environmental effects and conditions in space. The frame 32 includes annular first and second rims 50, 70 spaced along the axis 34 and interconnected by a plurality of struts 54, 74. The first rim 50 includes a plurality of interconnected longerons 52 and the second rim 70 includes a plurality of interconnected longerons 72. The first rim is 50 secured to the second rim 70 by a plurality of vertical struts 54 extending substantially parallel to the axis 34 and a plurality of diagonal struts 74 extending at an angle relative to the axis. More specifically, each vertical strut 54 includes an end 56 secured to the first rim 50 and an end 58 secured to the second rim 70.

Each diagonal strut 74 likewise includes an end 76 secured to the first rim 50 and an end 78 secured to the second rim 70. As illustrated, a diagonal strut 74 extends generally between each consecutive pair of vertical struts 54, although alternative configurations for the vertical and diagonal struts are contemplated. Collectively, the rims 50, 70 and struts 54, 74 cooperate to define a peripheral wall of the frame having a depth or height $H_1$ along the axis 34. The materials used for the first and second rims 50, 70 and vertical struts 54 are strong, stiff, substantially inextensible, and lightweight, e.g., a uniaxial fiber composite tubing. Each diagonal strut 74 may be a telescoping member constructed to have good tensile strength or may constitute a flexible, inextensible member.

The longerons 52, 72 constitute rigid members hinged end-to-end to one another to permit collapse and expansion of the reflector assembly 30 for stowing and deployment purposes. A series of connecting members 90 connect pairs of adjacent longerons 52 and a vertical strut 54 to one another around the first rim 50. Each connecting member 90 carries two pivot pins 92 by which two adjacent longerons 52 may pivot relative to one another and relative to the corresponding vertical strut 54. A freely rotatable pulley 94 is secured to every other connecting member 90 around the first rim 50.

Similarly, a series of connecting members 100 connect pairs of adjacent longerons 72 and a vertical strut 54 to one another around the second rim 70. Each connecting member 100 includes a support piece 102 on which two gears 104 and 106 are rotatably mounted. Each gear 104, 106 is fixed to an end of a respective longeron 72 so that rotation of either gear 104 or 106 results in pivotal movement of the longeron connected thereto. The gears 104, 106 on each connecting member 100 mesh with one another and therefore rotate in unison. Since the longerons 72 are secured to the gears 104, 106 and not the support piece 102 rotation of the gears pivots the longerons 72 relative to the vertical strut 74 associated therewith and relative to one another. The gears 104, 106 and pins 92 are configured such that the longerons 52 on the first rim 50 pivot in unison with the longerons 72 on the second rim 70 during expansion/collapsing of the frame 32.

Every other connecting member 100 further includes a pulley 108 rotatably mounted on the support piece 102 and positioned between the gears 104, 106. The connecting members 90, 100 are configured such that the pulleys 94 along the first rim 50 alternate with the pulleys 108 on the second rim 70 in a zig-zag manner around the perimeter of the frame 32. Each diagonal strut 74 extends between and is rigidly secured to a connecting member 90 that does not carry a pulley 94 and a connecting member 102 that does not carry a pulley 108.

Figure 5:
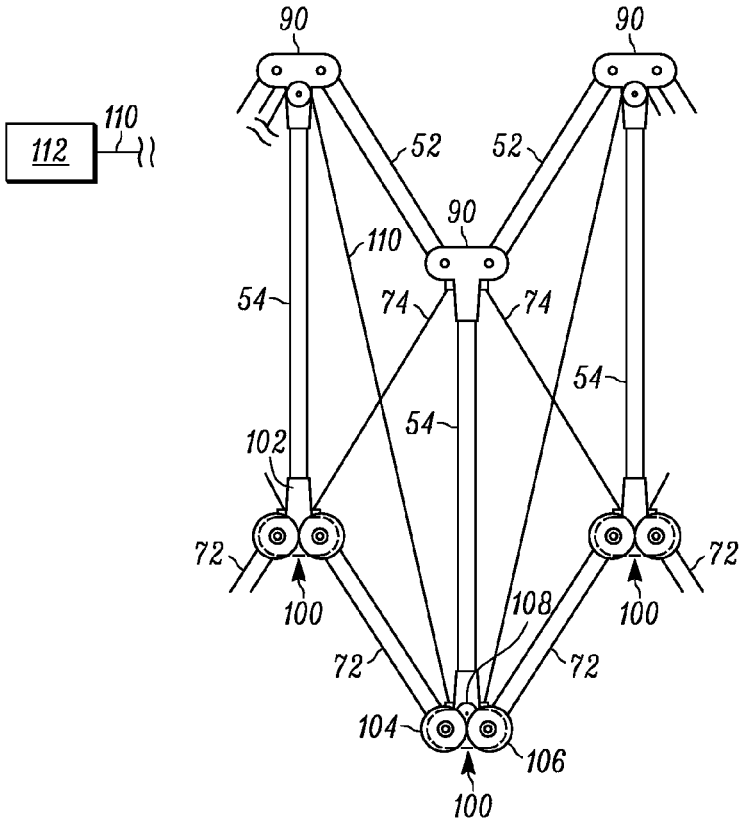
FIG. 5 is a partial view of the frame of FIG. 3 in a partially collapsed condition.

A deployment cable 110 is looped in an alternating manner around the pulleys 94 and 108 and thereby follows the zig-zag path around the perimeter of the frame 32. One end of the cable 110 is fixed to the frame 32 and the other end of the cable is secured to a mechanism, such as a motor 112, for tensioning the cable to deploy the frame. Due to this construction and the pivoting capability of the longerons 52, 72, the frame 32 is operable between a deployed condition (FIG. 4) and a collapsed or stowed condition (partially collapsed as shown in FIG. 5). In the deployed condition, the longerons 52 on the first rim 50 extend substantially perpendicular to the vertical struts 54 and the axis 34 to form a rigid, annular first rim. Likewise, the longerons 72 on the second rim 70 extend substantially perpendicular to the vertical struts 54 and the axis 34 to form a rigid, annular second rim. The longerons 52 therefore extend substantially parallel to the longerons 72 when the frame 32 is deployed.

Pivoting of the longerons 52 about the pins 92 and rotation of the longerons 72 with the gears 104, 106 allows the longerons 52, 72 to move radially closer to one another relative to the axis 34 (FIG. 5). This causes the connecting members 90 to move radially inward and closer to one another, thereby decreasing the diameter of the first rim 50. The connecting members 100 likewise move radially inward and closer to one another, thereby decreasing the diameter of the second rim 70. Consequently, the frame 32 collapses to a smaller, more compact size in which the longerons 52, 72 generally extend in the same vertical direction, which facilitates stowing and manipulation.

Figure 6:
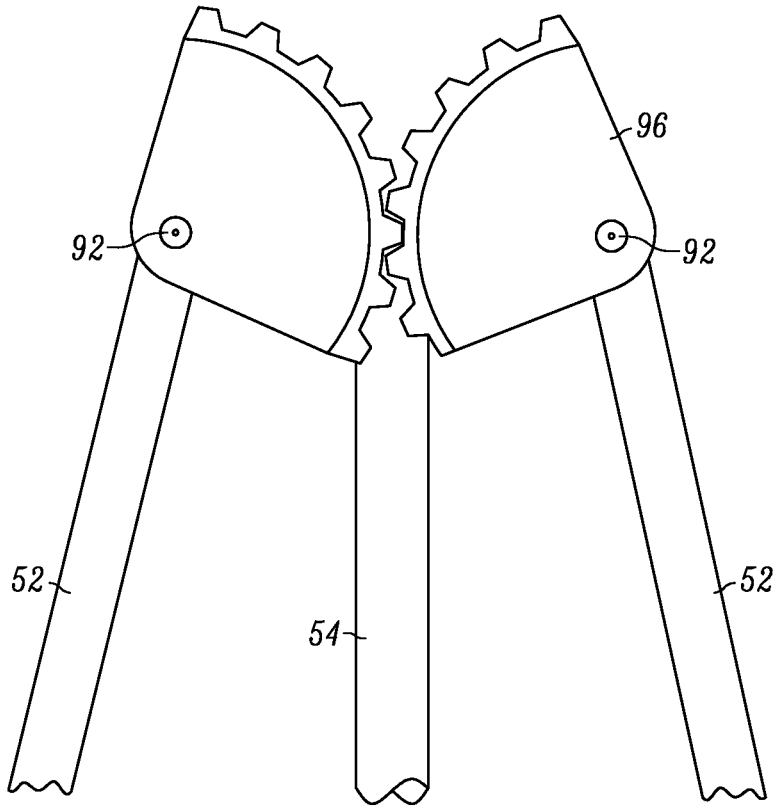
FIG. 6 is an enlarged view of another example of an articulating portion of the frame.

Referring to FIG. 6, in another example the longerons 52 of the first rim 50 may be coupled together via communicating rotatable gear sections 96 which enable synchronized deployment of the longerons 52. These gear sections 96 would therefore replace connecting members 90 along the first rim 50. The rotatable gear sections 96 along the first rim 50 may have the same construction as the gears 104, 106 on the second rim 70 or may have a different construction. As the frame 32 is deployed and thereby caused to expand, the interlocking gears 96 rotate to allow the first rim longerons 52 to lock into a fully deployed configuration at the same time, which minimizes stresses in the frame 32.

Figure 7A:
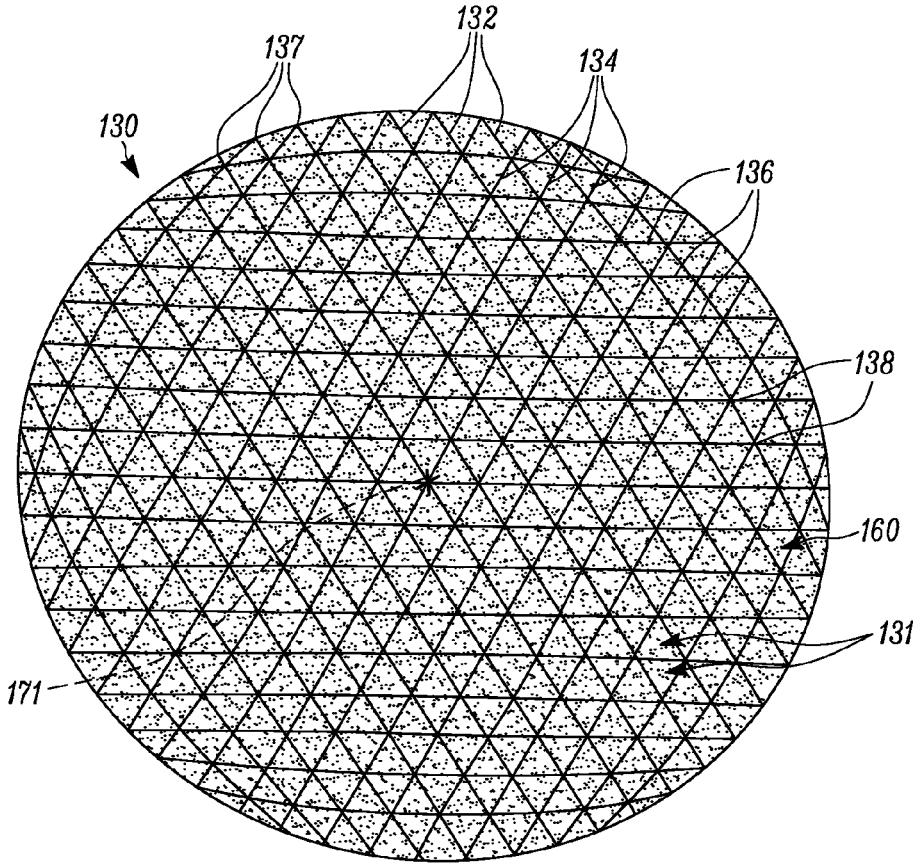
FIG. 7A is a schematic illustration of a first body and reflective mesh of the reflector assembly of FIG. 1.
Figure 7B:
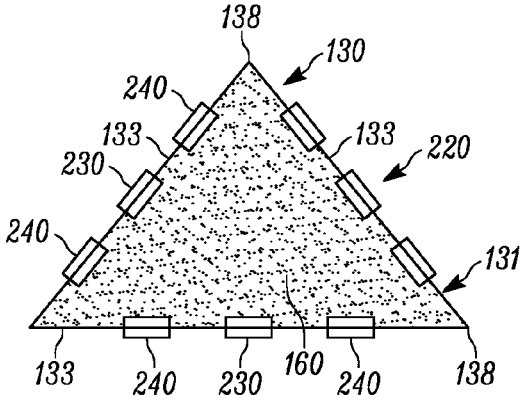
FIG. 7B is an enlarged view of a portion of FIG. 7A.
Figure 7C:
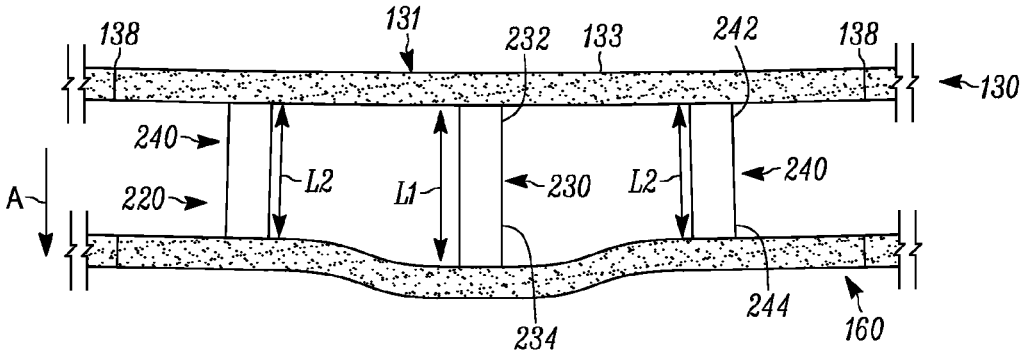
FIG. 7C is a side view of FIG. 7B.

FIGS. 7A-7C illustrate the first body 130 secured to the reflective mesh 160 by the support structure 220. The first body 130 constitutes a network or mesh net formed of a plurality of support members 132, 134, 136 and centered about an axis 171. The support members 132, 134, 136 act to support the reflective mesh 160 and constitute flexible, inextensible bands or tapes that collectively form a circular body. The support members 132, 134, 136 extend in three directions to form a mesh or net surface. The support members 132, 134, 136 cross over each other at points of intersection, or intersecting nodes 138 within the interior of the first body 130 to form a series of triangles nested in a desired shape, e.g., circular, hexagonal or elliptical. Intersection points of the support members 132, 134, 136 along the periphery of the first body 130 are indicated at 137.

The support members 132, 134, 136 cooperate with one another to define a series of concentric shapes each formed by a plurality of triangular facets 131. Generally, once the desired size of the first body 130 is determined based upon the operating frequency of the reflector assembly 30, the number and size of the facets 131 forming the first body is calculated to achieve the surface accuracy required for the desired operating frequency. Typically, the higher the operating frequency desired for the reflector assembly 30 the smaller the facets 131 and, thus, the more support members 132, 134, 136. FIG. 7A shows an example of a nine-ring configuration for an off-axis reflector, where the periphery of the first body 130 and the frame 32 (not shown) are configured to be elliptical to provide a circular aperture for the reflector assembly 30. Depending upon the particular application, the aperture size of the first body 130 may vary. Accordingly, the total number of triangular facets 131 and, therefore, the number of inextensible support members 132, 134, 136 in the first body 130 also varies. Referring to FIG. 7B, each facet 131 is formed by a series of sides 133 that intersect at vertices 138 to define the perimeter of the facet. Although three sides 133 and three vertices 138 are illustrated due to the triangular construction of the facets 131 it will be appreciated that alternatively shaped polygonal facets will have more sides and corresponding vertices.

Referring to FIGS. 7B and 7C, the support structure 220 secures the reflective mesh 160 to the rear or bottom side of the first body 130 and precisely shapes the reflective mesh into a curved or parabolic shape when the reflector assembly 30 is fully deployed. The support structure 220 includes a plurality of primary support members 230 and a plurality of secondary support members 240 securely fastened to the first body 130 and the reflective mesh 160 via welding or the like. The primary and secondary support members 230, 240 are elongated and constitute flexible, inextensible bands or tapes similar to the support members 132, 134, 136 of the first body 130. Each primary support member 230 extends from a first end 232 to a second end 234 and each secondary support member 240 extends from a first end 242 to a second end 244. Along one side 133 of one facet 131, the primary support member 230 has a length $L_1$ and each secondary support member 240 has a length $L_2$. The primary and secondary support members 230, 240 may have different lengths $L_1$, $L_2$ as shown or may have the same length. Additionally, the secondary support members 240 may have different lengths along the same side 133. In one example, the length $L_1$ of the primary support members 230 is greater than the length $L_2$ of the secondary support members 240 along each side 133 of one facet 131. The lengths $L_1$, $L_2$ of the support members 230, 240 may increase in a direction extending from the periphery of the first body 130 to the central axis 171. In other words, the support members 230, 240 may be the longest at the center of the first body 130 and shortest at the periphery of the first body.

A primary support member 230 is secured to at least one side 133 of at least one facet 131 on the first body 130. As shown, the first end 232 of a primary support member 230 is secured to each side 133 of each triangular facet 131 at roughly the midpoint of each side between the vertices 138 associated therewith. The primary support members 230, however, may be secured anywhere along the length of each side 133. Moreover, the primary support members 230 may be symmetrically or asymmetrically (not shown) arranged about the sides 133 on each facet 131. The second end 234 of each primary support member 230 is secured to the reflective mesh 160. The primary support members 230 may be angled relative to the axis 171 of the first body 130 or may be parallel thereto.

The secondary support members 240 are arranged in pairs on opposite sides of the primary support members 230 along at least one side 133 of at least one facet 131. As shown, a pair of secondary support members 240 is provided on each side 133 on each facet 131. The first ends 242 of each pair of secondary support members 240 is secured to each side 133 of each facet 131 at the midpoint between the primary support member 230 and each vertex 138 associated with that side. It will be appreciated, however, that each secondary support member 240 may be arranged anywhere along the length of each side 133 such that the secondary support members may be symmetrically or asymmetrically (not shown) arranged on each side 133. The second end 244 of each secondary support member 240 is secured to the reflective mesh 160. The secondary support members 240 may be angled relative to the axis 171 of the first body 130 or may be parallel thereto. In any case, the primary and second support members 230, 240 extend downward from the rear side of the first body 130 towards the second body 190 to space the reflective mesh 160 away from the first body.

Figure 8:
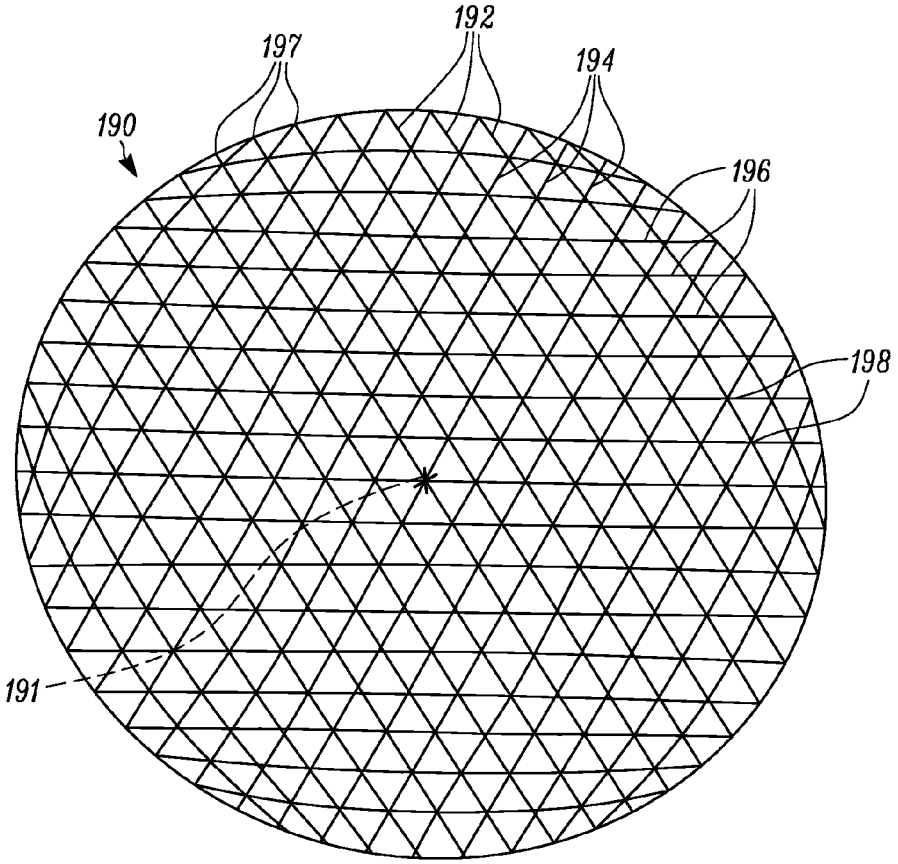
FIG. 8 is a schematic illustration of a second body of the reflector assembly of FIG. 1.

The support members 220 are advantageous in that the lengths $L_1$, $L_2$ of the primary and/or secondary support members 230, 240 can be specifically selected to precisely shape the reflective mesh 160 into the desired parabolic shape or contour. To this end, the lengths $L_1$, $L_2$ may vary between sides 133 and/or between facets 131 across the entire first body 130. Since the lengths $L_1$, $L_2$ of the support members 230, 240 may be different from one another the reflective mesh 160 may exhibit a different shape than the first body 130 to which it is attached. Furthermore, by adjusting the position of the support members 220 along the lengths of the side(s) 133 of the facets 131 in a random manner, the amount of hexagonal regularity in the reflective mesh 160 surface can be mitigated or even removed. This is beneficial in that hexagonal regularity in the reflective mesh 160 surface may generate RF lobe grating Referring to FIG. 8, the second body 190 is substantially identical in construction to the first body 130 and, thus, a thorough description of the second body is omitted for brevity. Accordingly, any reference features designated in the second body 190 are likewise present in the first body 130, e.g., support members 192, 194, 196, peripheral nodes 197, and intersecting nodes 198. The second body 190 is centered along an axis 191 and is provided to support the first body 130 and maintain the first body in a curved, parabolic shape during deployment and operation of the reflector body 30, as will be described. The second body 190 differs from the first body 130 only in that no reflective mesh 160 is secured thereto. Due to the substantially identical shape and construction of the first and second bodies 130, 190, each intersection node 138 of the first body 130 has a corresponding intersection node 198 on the second body 190.

The support members 132, 134, 136, 192, 194, 196 comprising the first and second bodies 130, 190 as well as the support members 230, 240 comprising the support structure 220 are made of a predominantly uniaxial fiber composite formed into strips having a rectangular cross-section. The material of each support member 132, 134, 136, 192, 194, 196, 230, 240 should have a high bending strain limit, be flexible to accommodate deployment and collapsing of the reflector assembly 30, and may be selected to have a low coefficient of thermal expansion with a high extensional modulus to withstand many possible environmental changes.

It will be recognized that the support members may constitute other types of band structures implemented to produce the triangular ring formation in the first and second bodies 130, 190. The construction of the first body 130 and the second body 190 is driven by the need to develop an extremely lightweight, yet strong mesh reflector support frame while simultaneously being collapsible. Although the following discussion is directed to the specific construction of the first body 130 it will be appreciated that the second body 190 is similarly constructed to the first body. In other words, components and methodologies used to describe the first body 130 are likewise applicable to the second body 190 but are omitted for brevity. Therefore, other types of support member 132, 134, 136 configurations may be used to accommodate a variety of weight and size limitations. To this end, continuous support members 132, 134, 136 may be used to form the net surface of the first body 130 and the second body 190.

Figure 9:
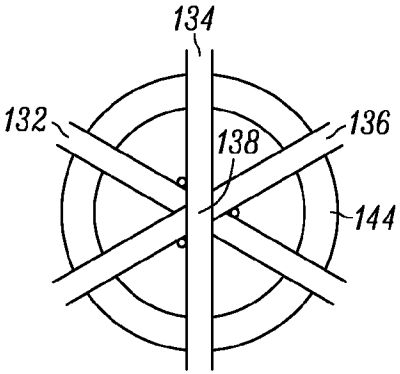

Referring to FIG. 9, continuous support members 132, 134, 136 for the first body 130 allow for precise and relatively easy positioning of the nodal intersections 138 of the first body 130 by simply shifting and adjusting the relative positions of the support members as desired. As described above, the support members 132, 134, 136 extend across the first body 130 in three criss-crossing directions to form a plurality of triangles arranged in a concentric pattern. The sets of continuous support members 132, 134, 136 may be laid over one another or the support members may be interwoven together to produce the desired triangular spacing and pattern in the first body 130 in a precise manner.

Figure 12:
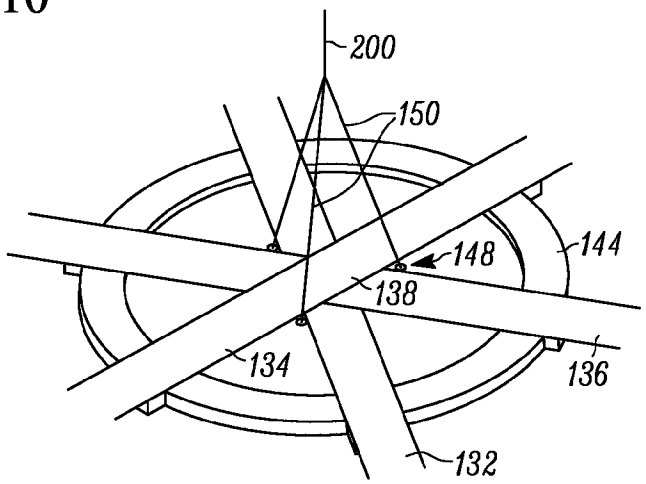
Figure 10:
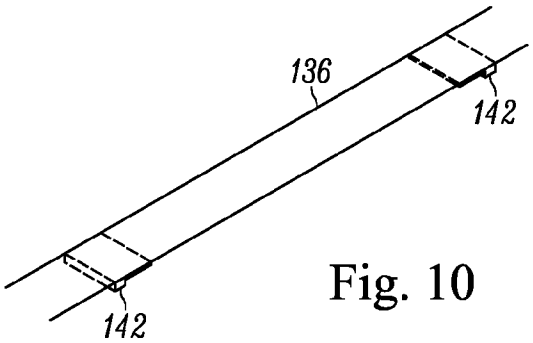
Figure 11:
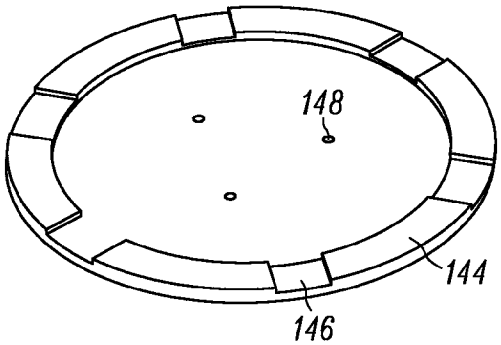

One or more of the support members 132, 134, 136 may include cooperating structure 142, 144 for tailoring the position of each intersecting node 138 to meet desired performance criterion for the reflector assembly 30. As shown in FIG. 10, precision stop elements 142 are disposed at intervals along the length of each support member 136, although it will be appreciated that stop elements are secured to every support member 132, 134, 136 in the first body 130. The stop elements 142 cooperate with positioning plates 144 to determine and set precise locations for the intersecting nodes 138. Referring to FIG. 11, the positioning plate 144 is a circular disk having machined grooves 146 provided about its perimeter and configured to receive the stop elements 142 on each support member 132, 134, 136 to reliably maintain the nodes 138 in the desired positions (FIG. 12). Accordingly, the diameter of the plates 144, location of the grooves 146, and/or the location of the stop elements 142 along the support members 132, 134, 136 can be adjusted to specifically configure the nodes 138 and mesh pattern of the first body 130 as desired. A series of anchor points 148 can be formed in each positioning plate 144 around the nodes 138 of the support members 132, 134, 136 for helping to connect the tensioning members 200 to the first and second bodies 130, 190, as will be discussed.

Figure 13:
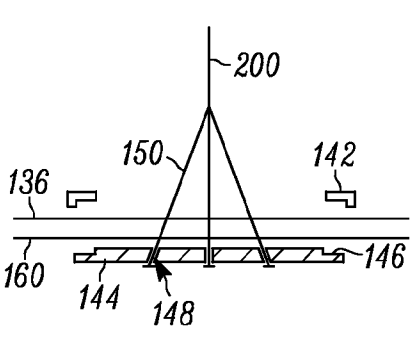
FIGS. 9-13 illustrate portions of the first body of FIG. 7.

As shown in FIG. 13, the cooperating structure 136, 144 also helps to secure the reflective mesh 160 to the first body 130. The reflective mesh 160 is stretched and held taught while being placed against the underside of the first body 130 to eliminate wrinkles and creases. The stop elements 142 are then secured within the grooves 146 of the plates 144 via fasteners or the like to sandwich the support members 132, 134, 136 between the plates and reflective mesh 160. The stop elements 142 and plates 144 rigidly connect the reflective mesh 160 to the first body 130 to provide a surface to the first body that reflects electromagnetic signals (see also FIG. 2). Since the reflective mesh 160 is extensible and tightly stretched across the rear side of the first body 130 the reflective mesh assumes the shape of the first body, i.e., the mesh forms taut triangular facets indicating the outline of the intersecting support members 132, 134, 136. The reflective mesh 160 is lightweight, yet durable enough to form a smooth, flat surface when tension is applied to the first body 130. The reflective mesh 160 may be comprised of a sheet of knitted reflective mesh material. In one example, the reflective mesh 160 is a warp-knitted, gold-plated molybdenum wire.

Figure 14:
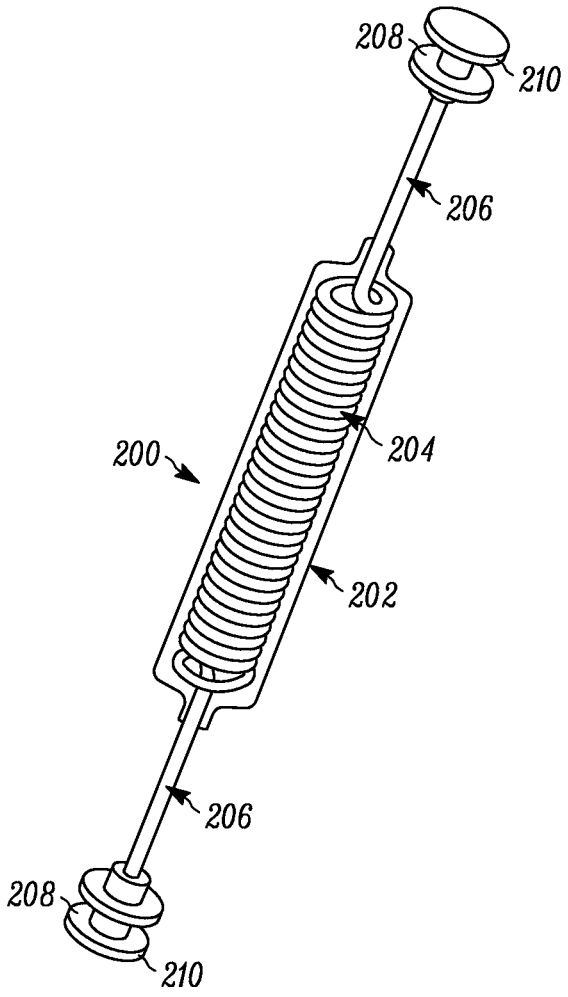
FIG. 14 is a sectional view of the tensioning member of the reflector assembly.

Maintaining the reflective mesh 160 in a curved or parabolic shape is important to optimizing the RF reflection properties of the reflector assembly 30 and, thus, several features are provided to accomplish this objective, namely, the tensioning members 200 and support structure 220. As illustrated in FIGS. 2 and 14 the tensioning members 200 are fastened between the first and second bodies 130, 190 to pull the first and second bodies towards one another and thereby increase the rigidity of the bodies. In one example, the tensioning members 200 are connected to the anchor points 148 on the plates 144 on each body 130, 190 by guide wires 150 (see FIGS. 12 and 13). Since the first and second bodies 130, 190 are substantially identical to one another, each plate 144 of the first body 130 has a corresponding plate on the second body 190 and, thus, the tensioning members 200 extend between a plurality of the anchor points 148 generally vertically aligned with one another on each body. Although a few representative tensioning members 200 are illustrated in FIG. 2, it will be appreciated that fewer or more tensioning members may be present in the reflector assembly 30 to ensure adequate pulling forces between the bodies 130, 190.

Referring to FIG. 14, each tensioning member 200 includes a tube or sleeve 202 through which a tension spring 204 extends. The tension spring 204 has two straight, free ends 206 and is formed by a single length of wire. A spindle 208 is provided at each free end 206 and secures the tensioning member 200 to the first and second bodies 130, 190. Each spindle 208 is a two-piece member having a clip 210 which can be securely attached, e.g., clipped or screwed, to the remainder of spindle. More specifically, one end 206 of the tensioning member 200 is secured to the guide wire 150 extending through the plate 144 of the first body 130 and the other end 206 is connected to the guide wire extending through the plate on the second body 190. Depending on the curvature of the first and second bodies 130, 190 the tensioning members 200 may extend parallel to the axis 34 of the frame and/or may extend at angles relative to the axis.

In another example (not shown), the spindles 208 replace the positioning plates shown 144 in FIGS. 11-13. In this case, the flexible support members 132, 134, 136 of each body 130, 190 and the reflective mesh 160 are provided with a hole at each intersection node 138. With the clips 210 removed, a pin (not shown) on each spindle 208 or clip is inserted through corresponding holes in the support members 132, 134, 136 and reflective mesh 160 at the nodes 138 and the clips reconnected to the spindles to secure the tensioning members 200 to the first and second bodies 130, 190. In any case, once the spindles 208 are secured to the first and second bodies 130, 160, the tensioning members 200 pull the bodies towards one another and help supply and maintain rigidity in the first and second bodies.

Referring to FIGS. 1 and 2, when the reflector assembly 30 is assembled, the peripheral points 137 of the first body 130, having the reflective mesh 160 secured thereto by the support structure 220, are secured to and along the first rim 50 of the frame 32. The peripheral points 197 of the second body 190 are secured to and along the second rim 70 of the frame 32. The first body 130 and the second body 190 have a generally convex shape. Consequently, the reflective mesh 160, which conforms generally to the shape of the first body 130, likewise has a convex shape. The support structure 220 further contours the shape of the reflective mesh 160 relative to the first body 130 in the manner described to achieve the specific shape desired. The tensioning members 200 are secured to and between the first and second bodies 130, 190 in the manner described and tensioned sufficient to rigidly maintain the bodies and reflective mesh 160 in their curved shapes. In order to properly maintain the curved shapes of the bodies 130, 190, it is desirable to keep the tensioning force substantially normal to the surface of the reflective mesh 160. Tension applied to the bodies 130, 190 in this manner helps to ensure that the support members 132, 134, 136 do not curve, bend or move out of position relative to one another as a result of uneven forces between tensioning members 200. Accordingly, it is desirable for the tensioning members 200 to apply constant pulling forces between the bodies 130, 190 to help ensure that the bodies maintain the appropriate curved shapes throughout operation of the reflector assembly 30.

In operation, and referring back to FIGS. 4-5, to deploy the reflector assembly 30, tension is applied to the end of the cable 110 by the motor 112, which shortens the length of the cable between consecutive pulleys 94. This causes the longerons 52, 72 to pivot about their associated connecting members 90, 100 via the pins 92 and gears 104, 106 through the state shown in FIG. 5 to the fully deployed state shown in FIG. 4. Each set of gears 104, 106 rotates in unison with rotation of the pins 92 so that all longerons 52, 72 pivot or rotate together to effect a smooth deployment of the frame 32 and bodies 130, 160.

Figure 15:
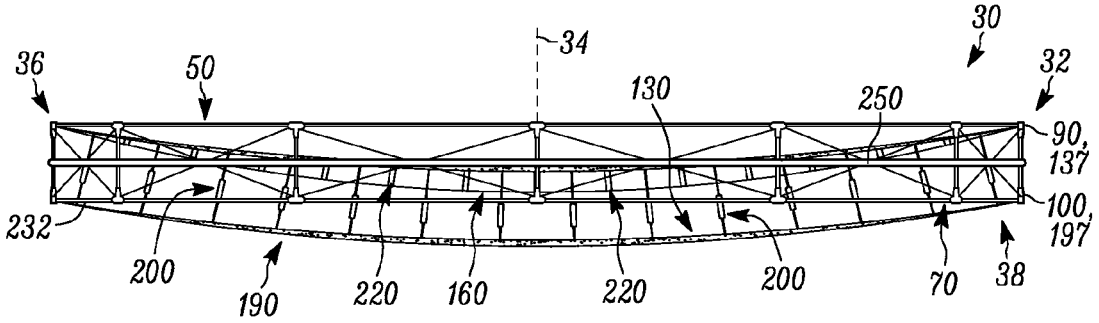
FIG. 15 is a side view of the reflector assembly of FIG. 2 secured to a deployment structure.
Figure 16A:
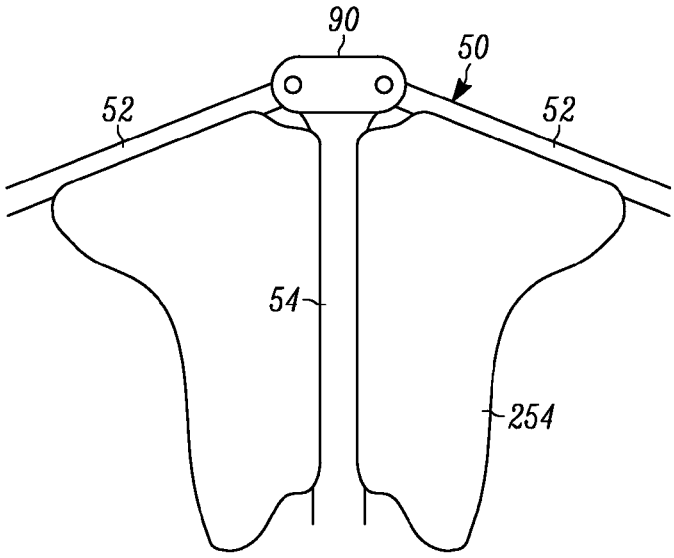
FIGS. 16A and 16B are enlarged portions of the rim of the reflector assembly secured to deployment devices.
Figure 16B:
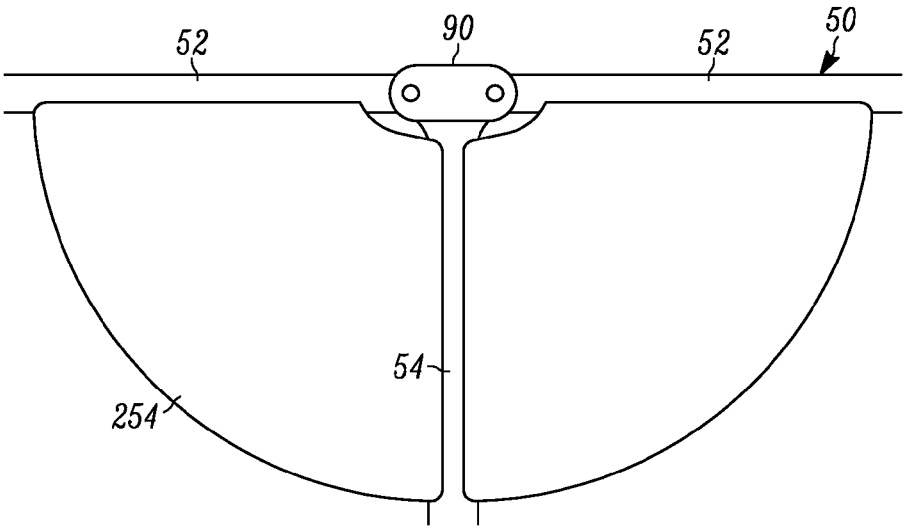

Alternatively, and referring to FIG. 15, the frame 32 may be deployed using a tubular inflatable device 250 or balloon coupled to the perimeter of the frame. Inflation or deflation of the device 250 causes the frame 32 to deploy or collapse, respectively. The frame 32 may therefore be deployed uniformly and synchronously upon inflation of the inflatable device 250. In another example shown in FIGS. 16A-B, a plurality of actuators 254 may be distributed around the frame 32 between each vertical strut 54 and the adjacent longeron 52 in the first rim 50 as well as between each vertical strut 54 and longeron 72 in the second rim 70 (not shown), which synchronizes deployment of the frame. Such distributed actuators 254 may comprise electrical drive motors, e.g., stepper motors, or a plurality of inflatable devices coupled between the vertical struts 54 and longerons 52, 72. Upon actuation of the motors 254 or inflation of inflatable devices, respectively, the frame 32 is deployed uniformly and synchronously. Deployment of the frame 32 causes the bodies 130, 190 and tensioning members 200 to tension and—in cooperation with the support structure 220—ultimately reach the steady-state positions shown in FIGS. 1-2.

Regardless of how the frame 32 is deployed, the pliable nature of the first and second bodies 130, 190 and reflective mesh 160 allows the bodies and reflective mesh to readily fold or collapse inwards (not shown) as the frame collapses. Collapsing the frame 32 necessarily causes the first and second bodies 130, 190 to have deeper or more severe curved configurations—and smaller diameters/footprints when the frame 32 is collapsed, thereby shrinking the size of the collapsed reflector assembly 30 and facilitating storage.

Figure 17:
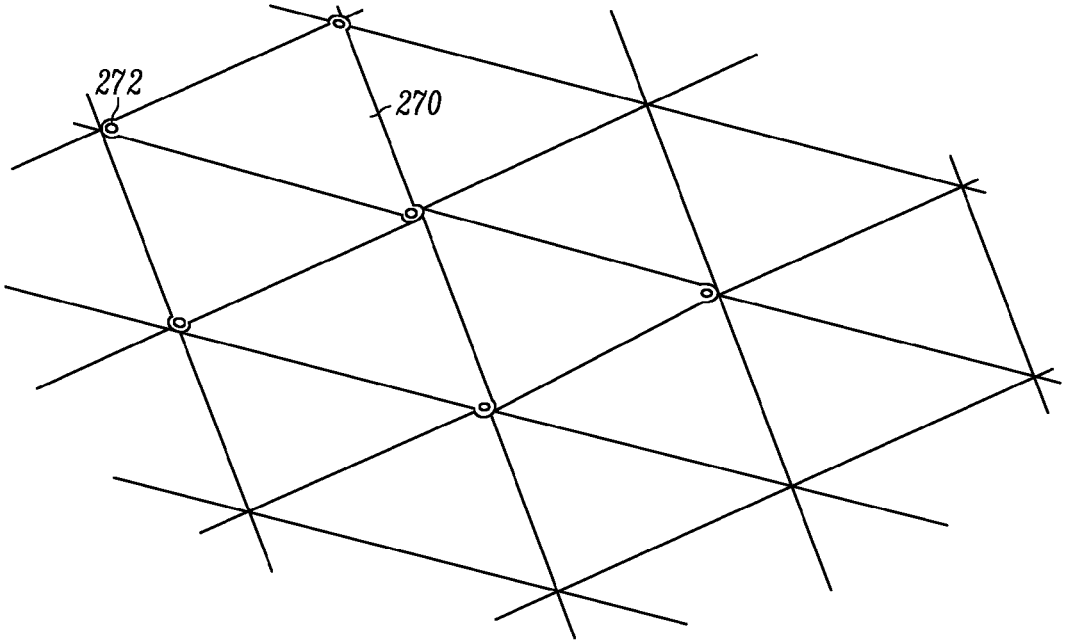
FIG. 17 is a schematic illustration of another example of a frame of the reflector assembly.

In lieu of a deployable frame 32, it may be desirable to construct the frame as a rigid, non-deployable structure with reduced weight compared to the deployable frame. In such a case, the frame 32, first body 130, and reflective mesh 160 may be transported and mounted on a spacecraft in a fully deployed state. The frame 32 may be constructed of cylindrical or square tubing bolted or otherwise rigidly affixed together and the reflective mesh 160 transported in an unfurled state. In this case, the reflector assembly 30 may be constituted by a membrane formed of a plurality of flat reflective polygonal, preferably triangular, facets 270 as shown in FIG. 17. It will be understood, however, that the reflector assembly 30 for use in the deployable frame 32 may likewise be formed from the reflective, polygonal facets 270 (not shown). Regardless, each facet 270 includes a sheet of a radar reflecting, electrically conductive metal, such as aluminum. The sheet has a thickness sufficient to withstand—without stretching or deformation—the tension forces required to hold the first and second bodies 130, 190 in the desired curved shapes. The reflective first body 130 will perform the functions of both the network of intersecting support members 123, 134, 136 and the reflective mesh 160 previously described herein.

In the example of FIG. 17, the corners of each facet 270 include a connecting point 272 to connect corresponding corners of adjacent facets. The tensioning members 200 previously discussed are connected to each point 272 and secure connect adjacent facets 270 together. The surface formed by facets 270 may be provided alone or may be associated with a network of the previously described support members 132, 134, 136. Regardless, the facets 270 may include a light reflecting finish or coating such that the reflector assembly 30 can be used as a solar radiation concentrator. Any known techniques for imparting a high level of light reflectivity to facets 270 may be employed.

Based on the construction of the reflector assembly 30 described herein, the reflective characteristics of the reflector assembly display a precise radiation response pattern and is particularly constructed to minimize structural errors and inconsistencies upon deployment in space. The curvature of the reflective mesh 160, which is formed by the first body 130 and support structure 220 and maintained by the tensioning members 200 and second body 190, precisely intercepts incoming RF or optical waves and reflects the waves to a common focal point. Since the first body 130 is located very close to the reflective mesh 160, incoming and outgoing electromagnetic signals are reflected off the reflective mesh without interference by the first body. As a result, the reflectivity of the reflector assembly 30 can be maximized.

The reflector assembly 30 is advantageous in that it is lightweight, compact, and maintains a precise, curved or parabolic reflective surface that is held in place during deployment and operation. The support structure 220 is advantageous in that it significantly reduces the number of support members 132, 134, 136, 192, 194, 196 and tensioning members 200 that would previously be required to produce a precisely contoured reflective mesh 160 typically used for a reflector having a higher operating frequency, which corresponds with a smaller facet size for the first body 130. For example, if a higher frequency operating range is required for the reflector assembly 30 the facet size of a seven-ring first body 130 would need to be reduced by half, resulting in the number of tensioning members 200 to be increased from 168 to 630—which is undesirable. Accordingly, the support structure 220, in providing for the ability to shape or contour the reflective mesh 160 along the lengths of the sides 133 of the facets 131, alleviates the need to increase the number of facets and corresponding tensioning members 200 in order to achieve greater contouring precision for the reflective mesh. By providing increased reflective mesh 160 contouring without increasing the number of first and second body 130, 190 facets the support structure 220 of the present invention advantageously minimizes the antenna gain loss that can be attributable to faceting and helps to maintain the structural integrity of the reflector assembly 30.

Additionally, the frame 32 and bodies 130, 190 produce a very stiff parabolic antenna surface with the reflective mesh 160 that can withstand a variety of external disturbances to thereby maintain the parabolic shape. As the frame 32 counteracts vertical distortion and thereby support the bodies 130, 190, the bodies likewise counteract radial distortion. Therefore, any external forces which impinge upon the frame 32 and bodies 130, 190 cancel each other. Accordingly, the frame 32 provides sufficient stability and stiffness to resist and counter the forces applied by the tensioning members 200 to the support members 132, 134, 136 of the bodies 130, 190 to thereby maintain the reflector assembly 30 in a force-neutral condition.

As noted, the frame 32 and bodies 130, 190 are collapsible for later deployment in space. Because the reflector assembly 30 must be transported to or launched in space and mounted to a variety of spacecraft, the overall package size of the collapsed reflector assembly before deployment is important. Depending upon the particular configuration of the bodies 130, 190 and frame, the bodies and frame 32 may be packaged with the parabolic bodies attached as a single, deployable unit. The bodies 130, 190 and reflective mesh 160 are made of sufficiently flexible materials to be compressed within a collapsed frame 32. The bodies 32 and reflective mesh 130, 190, however, may also be folded or otherwise compacted, depending upon the particular materials used.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A reflector assembly comprising:
- a frame centered about a longitudinal axis;
- a first curved body extending from the frame;
- a second curved body extending from the frame and connected to the first curved body for supporting the first curved body;
- a reflective mesh having an electromagnetically reflective surface; and
- a support structure securing the reflective mesh to the first curved body and spacing the reflective mesh away from the first body towards the second body.

2. The reflector assembly of claim 1, wherein the first and second curved bodies are convex.

3. The reflector assembly of claim 1, wherein the support structure comprises a plurality of inextensible spacers extending between the first curved body and the reflective mesh.

4. The reflector assembly of claim 3, wherein the first curved body includes a plurality of facets each having a plurality of sides, the support structure being secured to the sides of the facets.

5. The reflector assembly of claim 4, wherein each side extends between a first vertex and a second vertex, the support structures being positioned between the first and second vertices of at least one side of the facet.

6. The reflector assembly of claim 4, wherein the support structure comprises:
- a primary support member having a first length and being secured to at least one side of each facet, and
- a pair of secondary support members each having a second length different from the first length and being secured to the at least one side of each facet such that the primary support member is positioned between the pair of secondary support members on each side.

7. The reflector assembly of claim 1, wherein the support structure varies between facets.

8. The reflector assembly of claim 1, wherein the first curved body includes a periphery and is centered about an axis, the distance the support structure spaces the reflective mesh from the first body increasing in a direction extending from the periphery towards the axis.

9. The reflector assembly of claim 1, wherein the support structure spaces the reflective mesh from the first body such that the reflective mesh has a different shape than the first body.

10. The reflector assembly of claim 1 further comprising a plurality of tensioning members extending between the first curved body and the second curved body for maintaining the first curved body in a desired shape.

11. The reflector assembly of claim 1, wherein the frame includes a plurality of longerons and struts that are pivotable relative to one another such that the frame is moveable between a deployed condition and a collapsed condition.

12. The reflector assembly of claim 1, wherein the first curved body includes a plurality of inextensible support members interconnected to form a mesh net to which the reflective mesh is attached by the support structure.

13. A reflector assembly comprising:
- a frame centered about a longitudinal axis;
- curved first and second bodies extending from the frame, the first curved body including a plurality of facets each having a plurality of sides;
- a plurality of tensioning members extending between the first and second bodies for shaping the first body;
- a reflective mesh having an electromagnetically reflective surface; and
- a support structure being secured to the sides of the facets of the first body and to the reflective mesh for spacing the reflective mesh away from the first body towards the second body, the support structure including a plurality of primary support members secured to at least one facet and a plurality of secondary support members secured to the at least one facet, the primary and secondary support members on each facet having different lengths from one another such that the reflective mesh has a different shape than the first body.

14. The reflector assembly of claim 13, wherein the first and second curved bodies are convex.

15. The reflector assembly of claim 13, wherein primary and secondary support members comprise inextensible spacers extending between the first curved body and the reflective mesh.

16. The reflector assembly of claim 13, wherein the first curved body includes a periphery and is centered about an axis, the distance the support structure spaces the reflective mesh from the first body increasing in a direction extending from the periphery towards the axis.

17. The reflector assembly of claim 13, wherein each side extends between a first vertex and a second vertex, the support structure being positioned between the first and second vertices of at least one side of the facet.

18. The reflector assembly of claim 13, wherein the primary support members are secured to at least one side of each facet and the secondary support members are secured to the at least one side of each facet such that the primary support member is positioned between the secondary support members on each side.

19. The reflector assembly of claim 13, wherein the support structure varies between facets.

20. A reflector assembly comprising:

a frame centered about a longitudinal axis and having a plurality of longerons pivotable relative to one another and a plurality of struts pivotable relative to one another such that the frame is moveable between a deployed condition and a collapsed condition;

a first curved body extending from the frame and including a plurality of inextensible support members that define a mesh surface having a plurality of facets;

a second curved body connected to the first body by a plurality of tensioning members for maintaining the shape of the curved first body;

a flexible, reflective mesh having an electromagnetically reflective surface; and a support structure being secured to the first body and to the reflective mesh for spacing the reflective mesh away from the first body towards the second body, the support structure including a plurality of primary support members secured to at least one facet and a plurality of secondary support members secured to the at least one facet, the primary and secondary support members on each facet having different lengths from one another such that the reflective mesh has a different shape than the first body.

* * * * *